US008967295B2

(12) United States Patent
Habernal et al.

(10) Patent No.: US 8,967,295 B2
(45) Date of Patent: Mar. 3, 2015

(54) DRILL BIT-MOUNTED DATA ACQUISITION SYSTEMS AND ASSOCIATED DATA TRANSFER APPARATUS AND METHOD

(75) Inventors: Jason R. Habernal, Magnolia, TX (US); R. Keith Glasgow, Jr., Willis, TX (US); Eric C. Sullivan, Houston, TX (US); Tu Tien Trinh, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 794 days.

(21) Appl. No.: 13/214,399

(22) Filed: Aug. 22, 2011

(65) Prior Publication Data

US 2013/0048381 A1 Feb. 28, 2013

(51) Int. Cl.
*E21B 47/00* (2012.01)
*E21B 47/01* (2012.01)

(52) U.S. Cl.
CPC ..... *E21B 47/01* (2013.01)
USPC ..... 175/40; 175/50

(58) Field of Classification Search
USPC ..... 175/50, 57, 40; 340/854.3–854.5; 367/82
See application file for complete search history.

(56) References Cited

U.S. PATENT DOCUMENTS

| | | | | |
|---|---|---|---|---|
| 6,641,434 | B2 * | 11/2003 | Boyle et al. | 439/577 |
| 6,866,306 | B2 * | 3/2005 | Boyle et al. | 285/333 |
| 7,497,276 | B2 | 3/2009 | Pastusek et al. | |
| 7,506,695 | B2 | 3/2009 | Pastusek et al. | |
| 7,510,026 | B2 | 3/2009 | Pastusek et al. | |
| 7,604,072 | B2 | 10/2009 | Pastusek et al. | |
| 7,849,934 | B2 | 12/2010 | Pastusek et al. | |
| 7,913,773 | B2 * | 3/2011 | Li et al. | 175/40 |
| 7,987,925 | B2 * | 8/2011 | Pastusek et al. | 175/50 |
| 8,087,477 | B2 * | 1/2012 | Sullivan et al. | 175/40 |
| 8,164,980 | B2 * | 4/2012 | Sullivan et al. | 367/82 |
| 8,376,065 | B2 * | 2/2013 | Teodorescu et al. | 175/40 |
| 2008/0007424 | A1 * | 1/2008 | Hall | 340/854.8 |
| 2012/0031670 | A1 * | 2/2012 | Trinh et al. | 175/50 |
| 2012/0031672 | A1 * | 2/2012 | Trinh et al. | 175/57 |

* cited by examiner

*Primary Examiner* — Kenneth L Thompson
*Assistant Examiner* — Michael Wills, III
(74) *Attorney, Agent, or Firm* — TraskBritt

(57) ABSTRACT

A data acquisition module comprising a base sized and configured for disposition within a shank of a drill bit bore and an extension protruding therefrom having electrical contacts on an exterior surface thereof for connection to electrical contacts on an interior surface of a sub secured to the bit shank. A drill bit equipped with a data acquisition module, a bottom hole assembly including a drill bit bearing a data acquisition module operably coupled to a sub secured to the drill bit, and a method of transferring data from a data acquisition module carrying a data acquisition module to a sub secured to the drill bit.

12 Claims, 6 Drawing Sheets

DRILL BIT-MOUNTED DATA ACQUISITION SYSTEMS AND ASSOCIATED DATA TRANSFER APPARATUS AND METHOD

FIELD

The present disclosure relates generally to earth-boring drill bits carrying data acquisition systems. More particularly, embodiments of the present disclosure relate to facilitating data transfer from a data acquisition system mounted in a drill bit to a sub above the drill bit.

BACKGROUND

The oil and gas industry expends sizable sums to design cutting tools, such as downhole drill bits including roller cone rock bits and fixed cutter bits, which have relatively long service lives, with relatively infrequent failure. In particular, considerable sums are expended to design and manufacture roller cone rock bits and fixed cutter bits in a manner that minimizes the opportunity for catastrophic drill bit failure during drilling operations. The loss of a roller cone or a polycrystalline diamond compact (PDC) cutter from a fixed cutter bit during drilling operations can impede the drilling operations and, at worst, necessitate rather expensive fishing operations. If the fishing operations fail, sidetrack-drilling operations must be performed in order to drill around the portion of the wellbore that includes the lost roller cones or PDC cutters. Thus, during drilling operations, bits are pulled and replaced with new bits out of an abundance of caution, even though significant service could still be obtained from the replaced bit. These premature replacements of downhole drill bits are expensive, since each trip out of the well prolongs the overall drilling activity, and consumes considerable manpower, but are nevertheless done in order to avoid the far more disruptive and expensive process of, at best, pulling the drill string and replacing the bit or fishing and sidetrack drilling operations necessary if one or more cones or PDC cutters are lost due to bit failure.

In response to the ever-increasing need for downhole drilling system dynamic data, a number of "subs" (i.e., a subassembly incorporated into the drill string above the drill bit and used to collect data relating to drilling parameters) have been designed and installed in drill strings. Unfortunately, these subs cannot provide actual data for what is happening operationally at the bit due to their physical placement above the bit itself.

Data acquisition is conventionally accomplished by mounting a sub in the bottom hole assembly (BHA), which may be several feet to tens of feet away from the bit. Data gathered from a sub this far away from the bit may not accurately reflect what is happening directly at the bit while drilling occurs. Often, this lack of data leads to conjecture as to what may have caused a bit to fail or why a bit performed so well, with no directly relevant facts or data to correlate to the performance of the bit.

Recently, data acquisition systems have been proposed to install in the drill bit itself. For example, Baker Hughes Incorporated, assignee of the present invention, has developed a data acquisition system marketed under the trademark DATABIT®, embodiment of which are disclosed and claimed in U.S. Pat. No. 7,604,072; U.S. Pat. No. 7,497,276; U.S. Pat. No. 7,506,695; U.S. Pat. No. 7,510,026; and U.S. Pat. No. 7,849,934, each of which is assigned to the assignee of the present invention, and the disclosure of each of which is incorporated by reference herein in its entirety.

However, data reporting from these systems has been limited. Specifically, real-time data retrieval from a bit-mounted data acquisition system has been unavailable due to the lack of a robust technique for transferring data from the drill bit to the surface. As a consequence, data from such systems is, conventionally, only accessible when the drill bit has been tripped out of the well bore and the data acquisition system retrieved from the drill bit for data download. Such an approach limits the usefulness of information to the operator, who does not become aware of issues that may, if they could be addressed substantially in real time, enhance drilling performance and minimize the potential for damage to the drill bit.

BRIEF SUMMARY

The present disclosure includes a drill bit and a data acquisition system disposed within the drill bit and configured for transfer of data sampled by the system from physical parameters related to drill bit performance.

In one embodiment of the invention, a data acquisition module comprises a housing having a longitudinal bore therethrough and including a base configured for disposition within a bore of drill bit shank and an extension having electrical contacts disposed on an exterior surface thereof.

In another embodiment, a drill bit for drilling a subterranean formation comprises a bit body, a shank secured to the bit body, and a data acquisition module having a longitudinal bore and comprising base disposed within a bore of the shank and an extension protruding from the base beyond the shank and carrying electrical contacts on a peripheral exterior surface thereof.

In a further embodiment, a bottom hole assembly includes a sub comprising electrical contacts on an interior surface thereof operably coupled to electrical contacts on an exterior surface of a portion of a data acquisition module extending into the sub from a base received within a bore of a drill bit shank.

In yet another embodiment, a method of transferring data comprises acquiring data from at least one sensor carried by a drill bit and transferring the acquired data from at least a location within a shank of the drill bit through at least one physical data transfer path to an interior surface of a sub to which the shank is secured.

DETAILED DESCRIPTION

Figure 1:
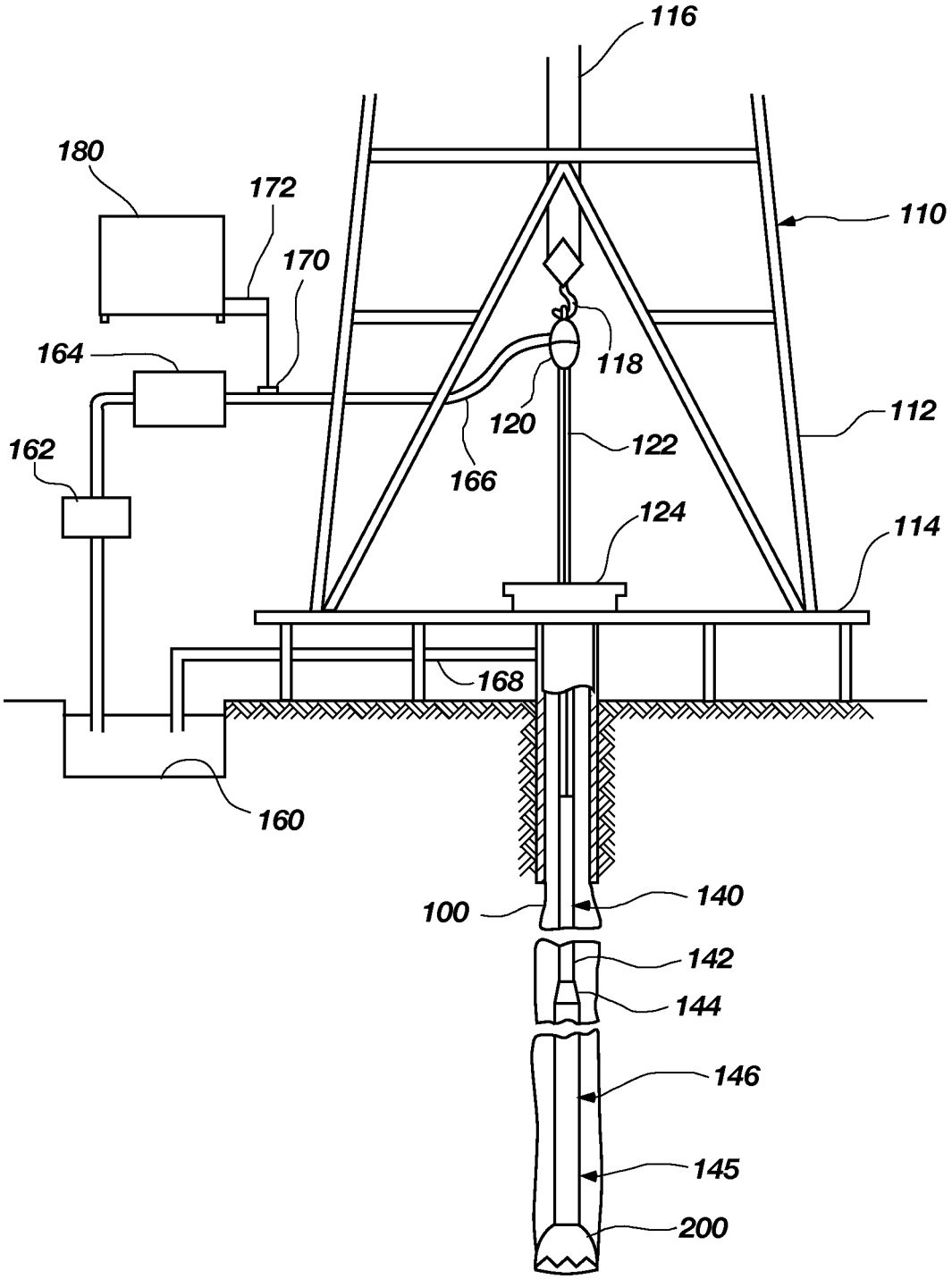
FIG. 1 illustrates a conventional drilling rig for performing drilling operations.

In the following detailed description, reference is made to the accompanying drawings that form a part hereof and, in which are shown by way of illustration, specific embodiments in which the invention may be practiced. These embodiments are described in sufficient detail to enable those of ordinary skill in the art to practice the invention, and it is to be understood that other embodiments may be utilized, and that structural, logical, and electrical changes may be made within the scope of the disclosure.

In this description, specific implementations are shown and described only as examples and should not be construed as the only way to implement the present invention unless specified otherwise herein. It will be readily apparent to one of ordinary skill in the art that the various embodiments of the present disclosure may be practiced by other partitioning solutions.

Referring in general to the following description and accompanying drawings, various embodiments of the present disclosure are illustrated to show its structure and method of operation. Common elements of the illustrated embodiments may be designated with similar reference numerals. It should be understood that the figures presented are not meant to be illustrative of actual views of any particular portion of the actual structure or method, but are merely idealized representations employed to more clearly and fully depict the present invention defined by the claims below. The illustrated figures may not be drawn to scale.

FIG. 1 depicts an embodiment of an apparatus for performing subterranean drilling operations. A drilling rig 110 includes a derrick 112, a derrick floor 114, a draw works 116, a hook 118, a swivel 120, a Kelly joint 122, and a rotary table 124. A drill string 140, which includes a drill pipe section 142 and a drill collar section 144, extends downward from the drilling rig 110 into a borehole 100. The drill pipe section 142 may include a number of tubular drill pipe members or strands connected together and the drill collar section 144 may likewise include a plurality of drill collars. In addition, the drill string 140 may include a measurement-while-drilling (MWD) logging subassembly 145 and cooperating mud pulse telemetry or wired data transmission subassembly, which may be referred generically to as a communication system 146, as well as other communication systems known to those of ordinary skill in the art.

During drilling operations, drilling fluid is circulated from a mud pit 160 through a mud pump 162, through a desurger 164, and through a mud supply line 166 into the swivel 120. The drilling mud (also referred to as drilling fluid) flows through the Kelly joint 122 and into an axial bore in the drill string 140. Eventually, it exits through apertures or nozzles, which are located in a drill bit 200, which is connected to the lowermost portion of the drill string 140 below drill collar section 144. The drilling mud flows back up through an annular space between the outer surface of the drillstring 140 and the inner surface of the borehole 100, to be circulated to the surface where it is returned to the mud pit 160 through a mud return line 168.

A shaker screen (not shown) may be used to separate formation cuttings from the drilling mud before it returns to the mud pit 160. The communication system 146 may utilize a mud pulse telemetry technique to communicate data from a downhole location to the surface while drilling operations take place. To receive data at the surface, a mud pulse transducer 170 is provided in communication with the mud supply line 166. This mud pulse transducer 170 generates electrical signals in response to pressure variations of the drilling mud in the mud supply line 166. These electrical signals are transmitted by a surface conductor 172 to a surface electronic processing system 180, which is conventionally a data processing system with a central processing unit for executing program instructions, and for responding to user commands entered through either a keyboard or a graphical pointing device. The mud pulse telemetry system is provided for communicating data to the surface concerning numerous downhole conditions sensed by well logging and measurement systems that are conventionally located within the communication system 146. Mud pulses that define the data propagated to the surface are produced by equipment conventionally located within the communication system 146. Such equipment typically comprises a pressure pulse generator operating under control of electronics contained in an instrument housing to allow drilling mud to vent through an orifice extending through the drill collar wall. Each time the pressure pulse generator causes such venting, a negative pressure pulse is transmitted to be received by the mud pulse transducer 170. An alternative conventional arrangement generates and transmits positive pressure pulses. As is conventional, the circulating drilling mud also may provide a source of energy for a turbine-driven generator subassembly (not shown) which may be located near a bottom hole assembly (BHA). The turbine-driven generator may generate electrical power for the pressure pulse generator and for various circuits including those circuits that form the operational components of the measurement-while-drilling tools. As an alternative or supplemental source of electrical power, batteries may be provided, particularly as a backup for the turbine-driven generator.

Figure 2:
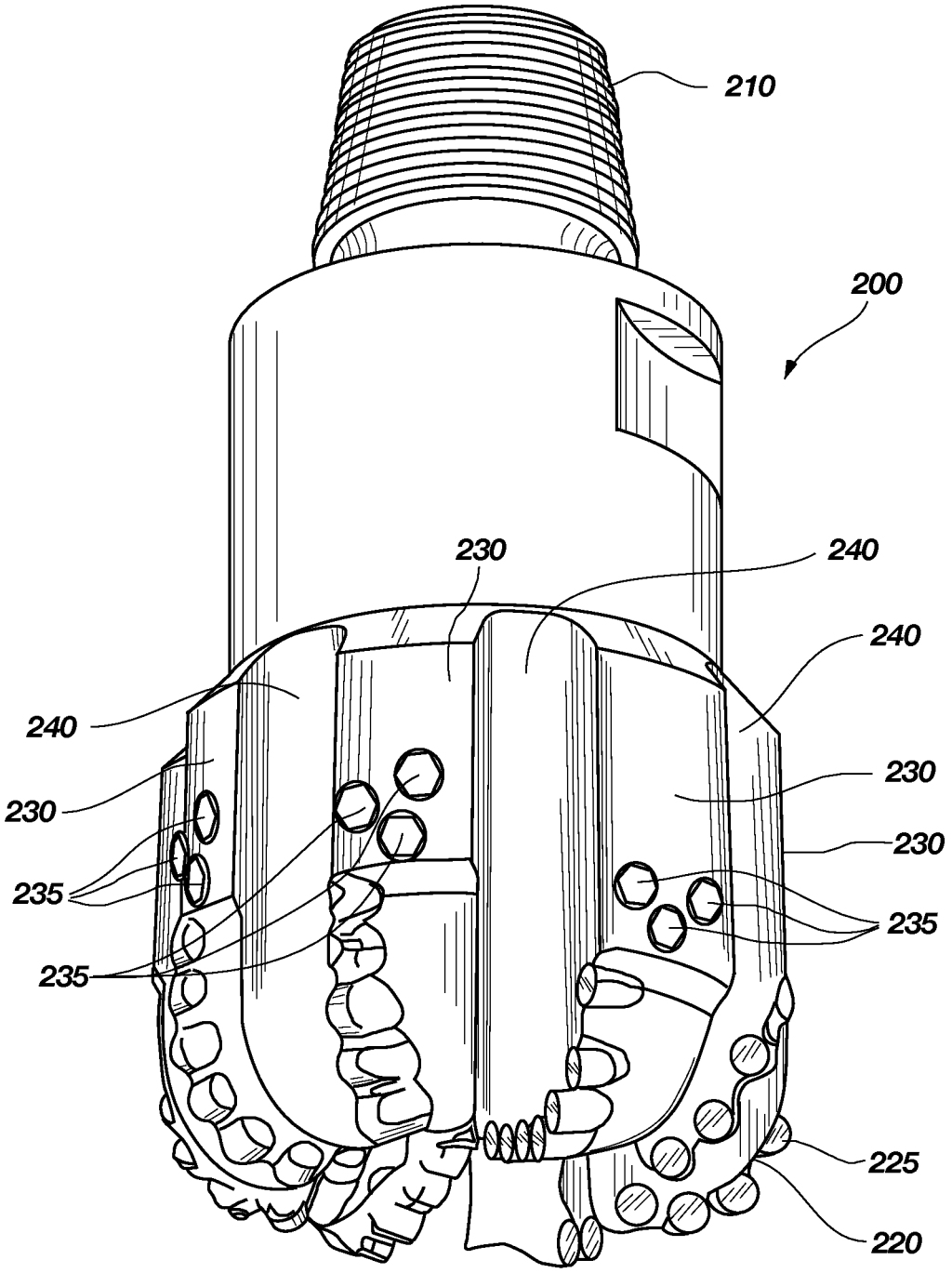
FIG. 2 is a perspective view of a conventional matrix-type rotary drag bit.

FIG. 2 is a perspective view of an embodiment of a drill bit 200 of a fixed-cutter, or so-called "drag" bit, variety. Conventionally, the drill bit 200 includes threads at a shank 210 at the upper extent of the drill bit 200 for connection into the drillstring 140. At least one blade 220 (a plurality show) at a generally opposite end from the shank 210 may be provided with a plurality of natural or synthetic diamonds (polycrystalline diamond compact) 225, arranged along the rotationally leading faces of the blades 220 to effect efficient disintegration of formation material as the drill bit 200 is rotated in the borehole 100 under applied weight on bit (WOB). A gage pad surface 230 extends upwardly from each of the blades 220, is proximal to, and generally contacts the sidewall of the borehole 100 during drilling operation of the drill bit 200. A plurality of channels 240, termed "junkslots," extend between the blades 220 and the gage pad surfaces 230 to provide a clearance area for removal of formation chips formed by the cutters 225.

A plurality of gage inserts 235 are provided on the gage pad surfaces 230 of the drill bit 200. Shear cutting gage inserts 235 on the gage pad surfaces 230 of the drill bit 200 provide the ability to actively shear formation material at the sidewall of the borehole 100 and to provide improved gage-holding ability in earth-boring bits of the fixed cutter variety. The drill bit 200 is illustrated as a PDC ("polycrystalline diamond compact") bit, but the gage inserts 235 may be equally useful in other fixed cutter or drag bits that include gage pad surfaces 230 for engagement with the sidewall of the borehole 100.

Those of ordinary skill in the art will recognize that the present invention may be embodied in a variety of drill bit types. The present invention possesses utility in the context of a tricone, also characterized as or roller cone, rotary drill bit or other subterranean drilling tools as known in the art that may employ nozzles for delivering drilling mud to a cutting structure during use. Accordingly, as used herein, the term "drill bit" includes and encompasses any and all rotary bits, including core bits, roller cone bits, fixed cutter bits; including PDC, natural diamond, thermally stable produced (TSP) synthetic diamond, and diamond impregnated bits without limitation, hybrid bits including both fixed and movable cutting structures, eccentric bits, bicenter bits, reamers, reamer wings, as well as other earth-boring tools configured for acceptance of an electronics module 290 (FIGS. 3A and 4).

Figure 3A:
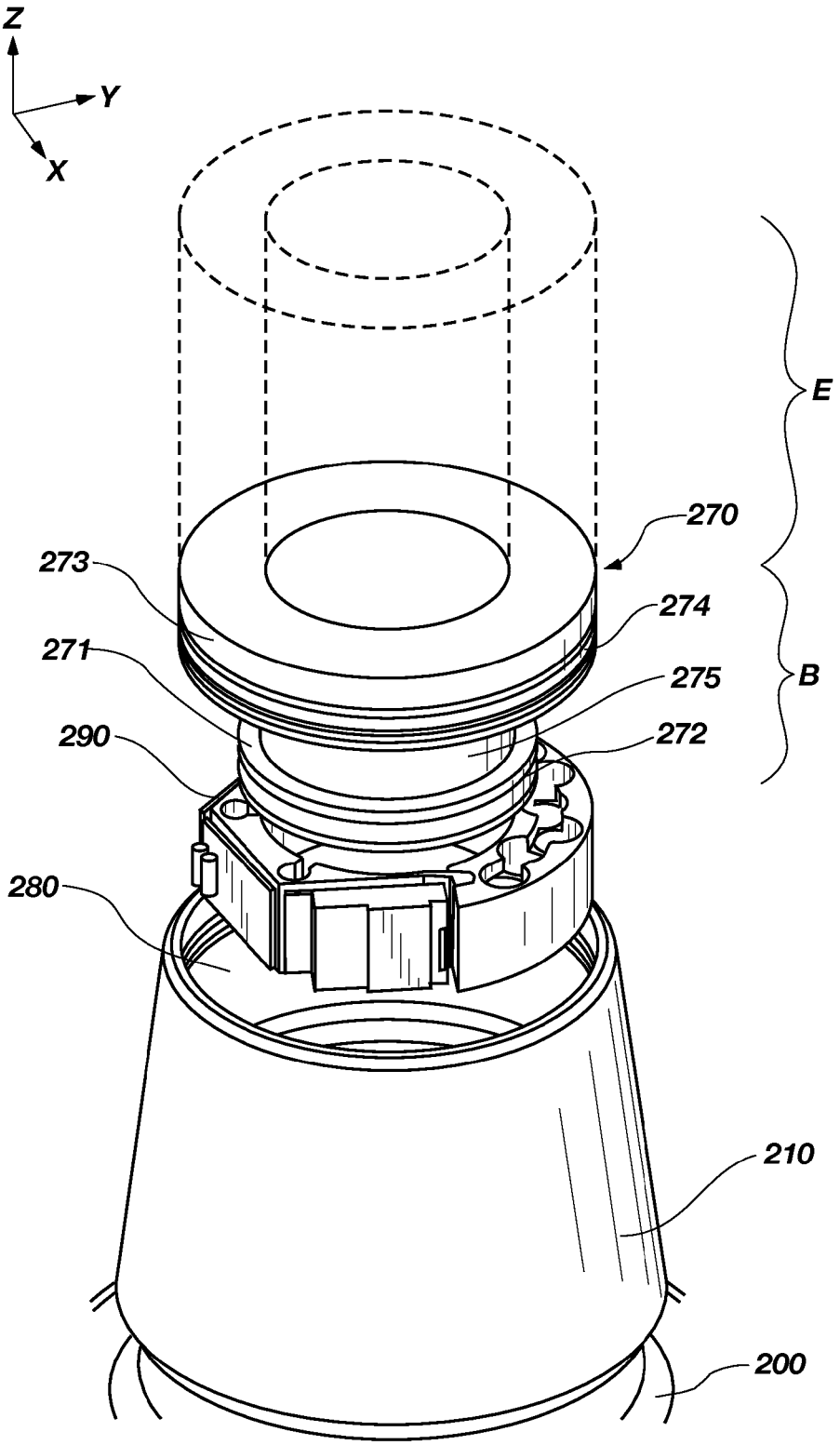
FIG. 3A is a perspective views of a shank, an electronics module, and an data acquisition module carrying the electronics module.
Figure 3B:
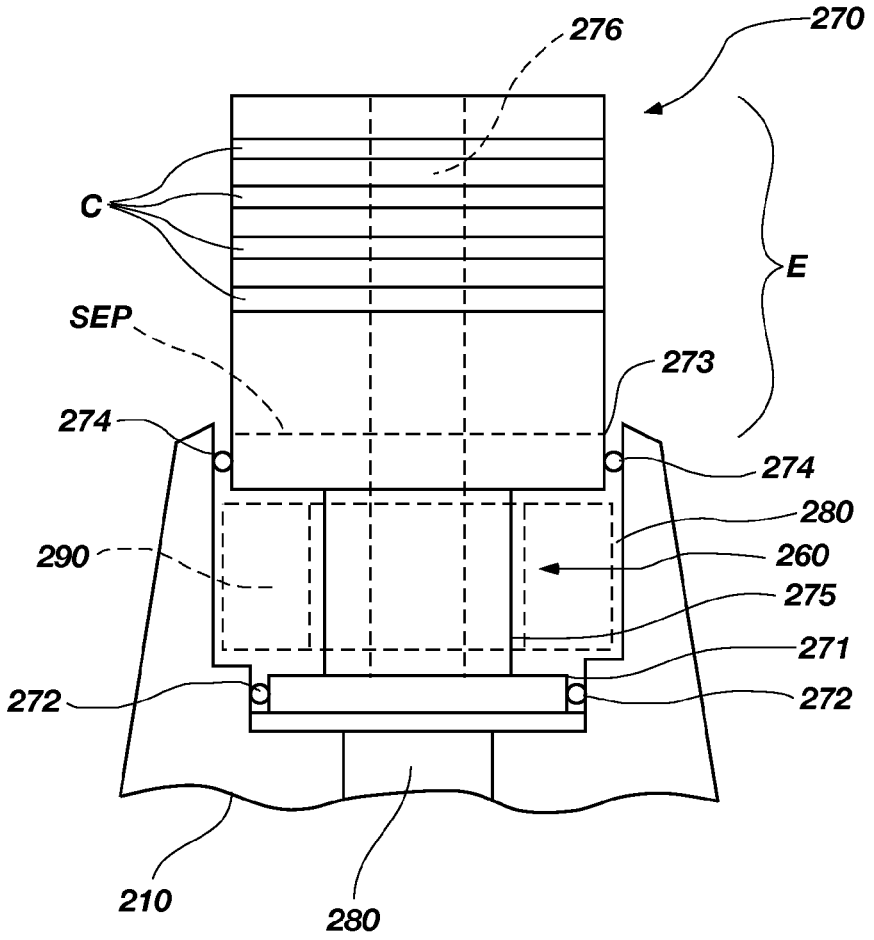
FIG. 3B is a cross-sectional views of a shank and an the data acquisition module and electronics module of FIG. 3A.
Figure 4:
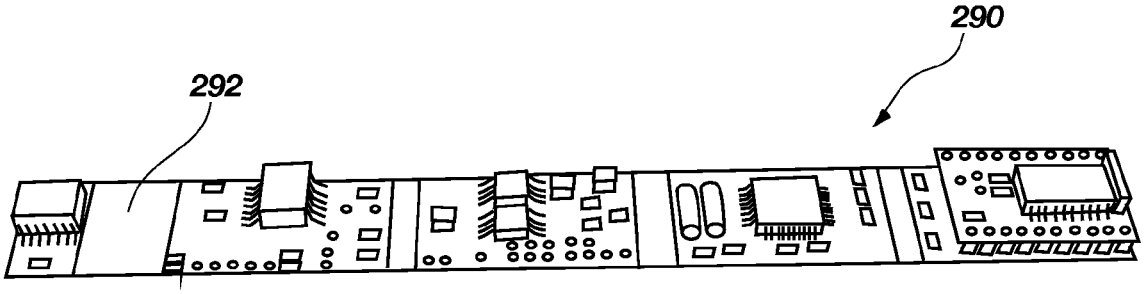
FIG. 4 is a perspective view of an electronics module configured as a flex-circuit board enabling formation into an annular ring suitable for disposition in the shank shown in FIGS. 3A and 3B.

FIGS. 3A and 3B illustrates an embodiment of a shank 210 secured to a body of drill bit 200. FIG. 3A depicts data acquisition module 270 comprising a base B received in shank 210 of drill bit 200, and an embodiment of an electronics module 290 (shown schematically in FIG. 3B). An extension E is also depicted in broken lines in FIG. 3A, and described in more detail with regard to FIGS. 3B and 6. The shank 210 includes a bore 280 formed through the longitudinal axis of the shank 210. In conventional drill bits 200, this bore 280 is configured for allowing drilling mud to flow therethrough. In the present invention, at least a portion of the bore 280 is given a diameter sufficient for accepting the electronics module 290 configured in a substantially annular ring, yet without substantially affecting the structural integrity of the shank 210. Thus, the electronics module 290 residing in base B may be placed down in a portion within the shank 210 of the bore 280, disposed about a base body 275 of data acquisition module 270, which extends through the inside diameter of the annular ring of the electronics module.

The base B of data acquisition module 270 includes a longitudinal bore 276 formed therethrough, such that the drilling mud may flow through the data acquisition module 270, through the bore 280 of the shank 210 to the other side of the shank 210, and then into the body of drill bit 200. In addition, the base B of data acquisition module 270 includes a first flange 271 including a first sealing ring 272, protruding laterally from base body 275 near the lower end of the base B, and a longitudinally separated second flange 273 including a second sealing ring 274 protruding laterally from base body 275, near the upper end of the base B of data acquisition module 270 to create a fluid tight annular chamber 260 (FIG. 3B) with the walls of central bore 280 and seal the electronics module 290 in place within the shank 210.

FIG. 3B is a cross-sectional view of the data acquisition module 270 having base B carrying electronics module 290 disposed in the shank, illustrating the annular chamber 260 formed between the first flange 271, the second flange 273, the base body 275, and the walls of the bore 280. The first sealing ring 272 and the second sealing ring 274 form a protective, fluid tight, peripheral seal between the base B of data acquisition module 270 and the walls of the bore 280 to protect the electronics module 290 from adverse environmental conditions. The protective seal formed by the first sealing ring 272 and the second sealing ring 274 may also be configured to maintain the annular chamber 260 at approximately atmospheric pressure.

FIG. 3B also illustrates an extension E protruding longitudinally from base B (a separation between base B and extension E being indicated by broken line SEP) beyond the end of shank 210. Extension E comprises, on a peripheral exterior surface thereof, electrical contacts C which may comprise, for example, annular rings of electrically conductive material for communication between electronics module 290 within base B and components residing in a sub 500 (FIG. 6) to which shank 210 is secured. As used herein the term "communication" means and includes signals in the form of data communication from or to electronics module 290, or both, as well as communication of power, without limitation.

In the embodiment shown in FIGS. 3A and 3B, the first sealing ring 272 and the second sealing ring 274 are formed of material suitable for high-pressure, high temperature environment, such as, for example, a Hydrogenated Nitrile Butadiene Rubber (HNBR) O-ring in combination with a PEEK back-up ring. In addition, the end-cap 270 may be secured to the shank 210 with a number of connection mechanisms such as, for example, a secure press-fit using sealing rings 272 and 274, a threaded connection, an epoxy connection, a shape-memory retainer, welded, and brazed. It will be recognized by those of ordinary skill in the art that the base B of data acquisition module 270 may be held in place quite firmly by a relatively simple connection mechanism due to differential pressure and downward mud flow during drilling operations.

An electronics module 290 configured as shown in the embodiment of FIG. 3A may be configured as a flex-circuit board 292, enabling the formation of the electronics module 290 into the annular ring suitable for disposition about the base body 275 of data acquisition module 270 within chamber 260 of bore 280. This flex-circuit board embodiment of the electronics module 290 is shown in a flat uncurled configuration in FIG. 4. The flex-circuit board 292 includes a high-strength reinforced backbone (not shown) to provide acceptable transmissibility of acceleration effects to sensors such as accelerometers. In addition, other areas of the flex-circuit board 292 bearing non-sensor electronic components may be attached to the end-cap 270 in a manner suitable for at least partially attenuating the acceleration effects experienced by the drill bit 200 during drilling operations using a material such as a visco-elastic adhesive.

Figure 5:
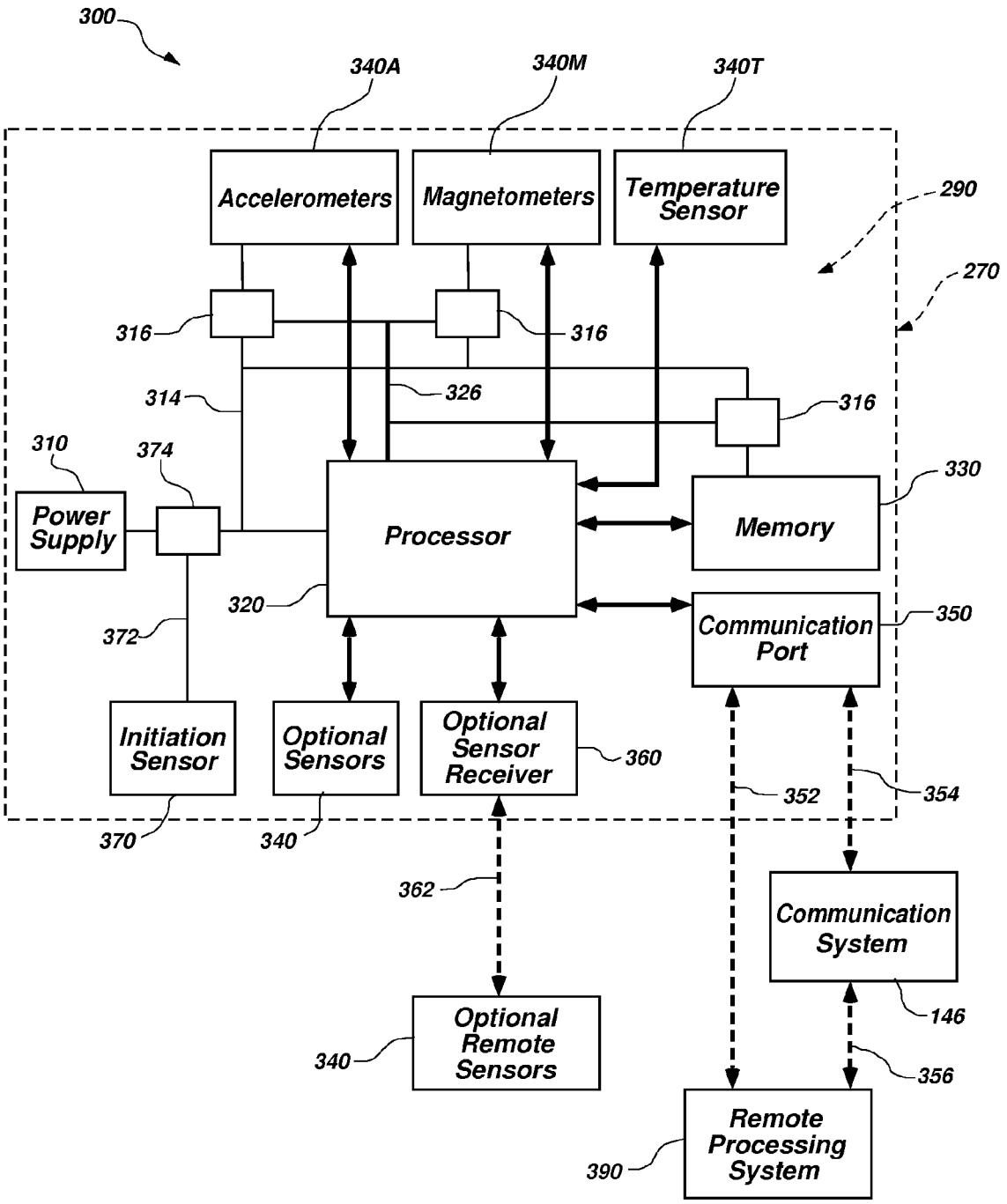
FIG. 5 is a functional block diagram of an embodiment of a data acquisition system including a data acquisition module configurable according to the disclosure.

A functional block diagram of an embodiment of a data acquisition system 300 configurable according to an embodiment of the disclosure and including a data acquisition module 270 including electronics module 290 is illustrated in FIG. 5. The electronics module 290 includes a power supply 310, a processor 320, a memory 330, and at least one sensor 340 configured for measuring a plurality of physical parameter related to a drill bit state, which may include drill bit condition, drilling operation conditions, and environmental conditions proximate the drill bit. In the embodiment of FIG. 5, the sensors 340 include a plurality of accelerometers 340A, a plurality of magnetometers 340M, and at least one temperature sensor 340T.

The plurality of accelerometers 340A may include three accelerometers 340A configured in a Cartesian coordinate arrangement. Similarly, the plurality of magnetometers 340M may include three magnetometers 340M configured in a Cartesian coordinate arrangement. While any coordinate system may be defined within the scope of the present invention, an exemplary Cartesian coordinate system, shown in FIG. 3A, defines a z-axis along the longitudinal axis about which the drill bit 200 rotates, an x-axis perpendicular to the z-axis, and a y-axis perpendicular to both the z-axis and the x-axis, to form the three orthogonal axes of a typical Cartesian coordinate system. Because the data acquisition module 270 may be used while the drill bit 200 is rotating and with the drill bit 200 in other than vertical orientations, the coordinate system may be considered a rotating Cartesian coordinate system with a varying orientation relative to the fixed surface location of the drilling rig 110.

The accelerometers 340A of the FIG. 5 embodiment, when enabled and sampled, provide a measure of acceleration of the drill bit 200 along at least one of the three orthogonal axes. The data acquisition module 300 may include additional accelerometers 340A to provide a redundant system, wherein various accelerometers 340A may be selected, or deselected, in response to fault diagnostics performed by the processor 320.

The magnetometers 340M of the FIG. 5 embodiment, when enabled and sampled, provide a measure of the orientation of the drill bit 200 along at least one of the three orthogonal axes relative to the earth's magnetic field. The data acquisition module 300 may include additional magnetometers 340M to provide a redundant system, wherein various magnetometers 340M may be selected, or deselected, in response to fault diagnostics performed by the processor 320.

The temperature sensor 340T may be used to gather data relating to the temperature of the drill bit 200, and the temperature near the accelerometers 340A, magnetometers 340M, and other sensors 340. Temperature data may be useful for calibrating the accelerometers 340A and magnetometers 340M to be more accurate at a variety of temperatures.

Other optional sensors 340 may be included as part of the data acquisition module 270. Examples of sensors that may be useful in the present invention are strain sensors at various locations of the drill bit, temperature sensors at various locations of the drill bit, mud (drilling fluid) pressure sensors to measure mud pressure internal to the drill bit, and borehole pressure sensors to measure hydrostatic pressure external to the drill bit. These optional sensors 340 may include sensors 340 that are integrated with and configured as part of the data acquisition module 300. These sensors 340 may also include optional remote sensors 340 placed in other areas of the drill bit 200, or above the drill bit 200 in the bottom hole assembly. The optional sensors 340 may communicate using a direct-wired connection, or through an optional sensor receiver 360. The sensor receiver 360 is configured to enable wireless remote sensor communication 362 across limited distances in a drilling environment as are known by those of ordinary skill in the art.

One or more of these optional sensors may be used as an initiation sensor 370. The initiation sensor 370 may be configured for detecting at least one initiation parameter, such as, for example, turbidity of the mud, and generating a power enable signal 372 responsive to the at least one initiation parameter. A power gating module 374 coupled between the power supply 310, and the data acquisition module 300 may be used to control the application of power to the data acquisition module 300 when the power enable signal 372 is asserted. The initiation sensor 370 may have its own independent power source, such as a small battery, for powering the initiation sensor 370 during times when the data acquisition module 300 is not powered. As with the other optional sensors 340, some examples of parameter sensors that may be used for enabling power to the data acquisition module 300 are sensors configured to sample; strain at various locations of the drill bit, temperature at various locations of the drill bit, vibration, acceleration, centripetal acceleration, fluid pressure internal to the drill bit, fluid pressure external to the drill bit, fluid flow in the drill bit, fluid impedance, and fluid turbidity. In addition, at least some of these sensors may be configured to generate any required power for operation such that the independent power source is self-generated in the sensor. By way of example, and not limitation, a vibration sensor may generate sufficient power to sense the vibration and transmit the power enable signal 372 simply from the mechanical vibration.

The memory 330 may be used for storing sensor data, signal processing results, long-term data storage, and computer instructions for execution by the processor 320. Portions of the memory 330 may be located external to the processor 320 and portions may be located within the processor 320. The memory 330 may be Dynamic Random Access Memory (DRAM), Static Random Access Memory (SRAM), Read Only Memory (ROM), Nonvolatile Random Access Memory (NVRAM), such as Flash memory, Electrically Erasable Programmable ROM (EEPROM), or combinations thereof. In the FIG. 6 embodiment, the memory 330 is a combination of SRAM in the processor (not shown), Flash memory 330 in the processor 320, and external Flash memory 330. Flash memory may be desirable for low power operation and ability to retain information when no power is applied to the memory 330.

A communication port 350 may be included in the data acquisition module 270 for communication to external devices such as the communication system 146 and a remote processing system 390. The communication port 350 may be configured for a direct communication link 352 to the remote processing system 390 using a direct wire connection or a wireless communication protocol, such as, by way of example only, infrared, BLUETOOTH®, and 802.11a/b/g protocols. Using the direct communication, the data acquisition module 270 may be configured to communicate with a remote processing system 390 such as, for example, a computer, a portable computer, and a personal digital assistant (PDA) when the drill bit 200 is not downhole. Thus, the direct communication link 352 may be used for a variety of functions, such as, for example, to download software and software upgrades, to enable setup of the data acquisition module 300 by downloading configuration data, and to upload sample data and acquisition data. The communication port 350 may also be used to query the data acquisition module 270 for information related to the drill bit, such as, for example, bit serial number, data acquisition module serial number, software version, total elapsed time of bit operation, and other long term drill bit data which may be stored in the NVRAM.

The communication port 350 may also be configured for communication with the communication system 146 in a bottom hole assembly via a communication link 354 according to the present disclosure. The communication system 146 may, in turn, communicate data from the data acquisition module 270 to a remote processing system 390 using mud pulse telemetry 356 or other suitable communication means suitable for communication across the relatively large distances encountered in a drilling operation.

The processor 320 in the embodiment of FIG. 5 is configured for processing, analyzing, and storing collected sensor data. For sampling of the analog signals from the various sensors 340, the processor 320 of this embodiment includes a digital-to-analog converter (DAC). However, those of ordinary skill in the art will recognize that the present invention may be practiced with one or more external DACs in communication between the sensors 340 and the processor 320. In addition, the processor 320 in the embodiment includes internal SRAM and NVRAM. However, those of ordinary skill in the art will recognize that the present invention may be practiced with memory 330 that is only external to the processor 320 as well as in a configuration using no external memory 330 and only memory 330 internal to the processor 320.

The embodiment of FIG. 5 uses battery power as the operational power supply 310. Battery power enables operation without consideration of connection to another power source while in a drilling environment. However, with battery power, power conservation may become a significant consideration in the present invention. As a result, use a low power processor 320 and low power memory 330 may enable longer battery life. Similarly, other power conservation techniques may be significant in implementation of embodiments of the present disclosure. It should be noted that extension E of data acquisition module 270 may be employed to house additional batteries, or sub 500, as described below, may house additional batteries.

The embodiment of FIG. 5 illustrates power controllers 316 for gating the application of power to the memory 330, the accelerometers 340A, and the magnetometers 340M. Using these power controllers 316, software running on the processor 320 may manage a power control bus 326 including control signals for individually enabling a voltage signal 314 to each component connected to the power control bus 326. While the voltage signal 314 is shown in FIG. 5 as a single signal, it will be understood by those of ordinary skill in the art that different components may require different voltages. Thus, the voltage signal 314 may be a bus including the voltages necessary for powering the different components.

Figure 6:
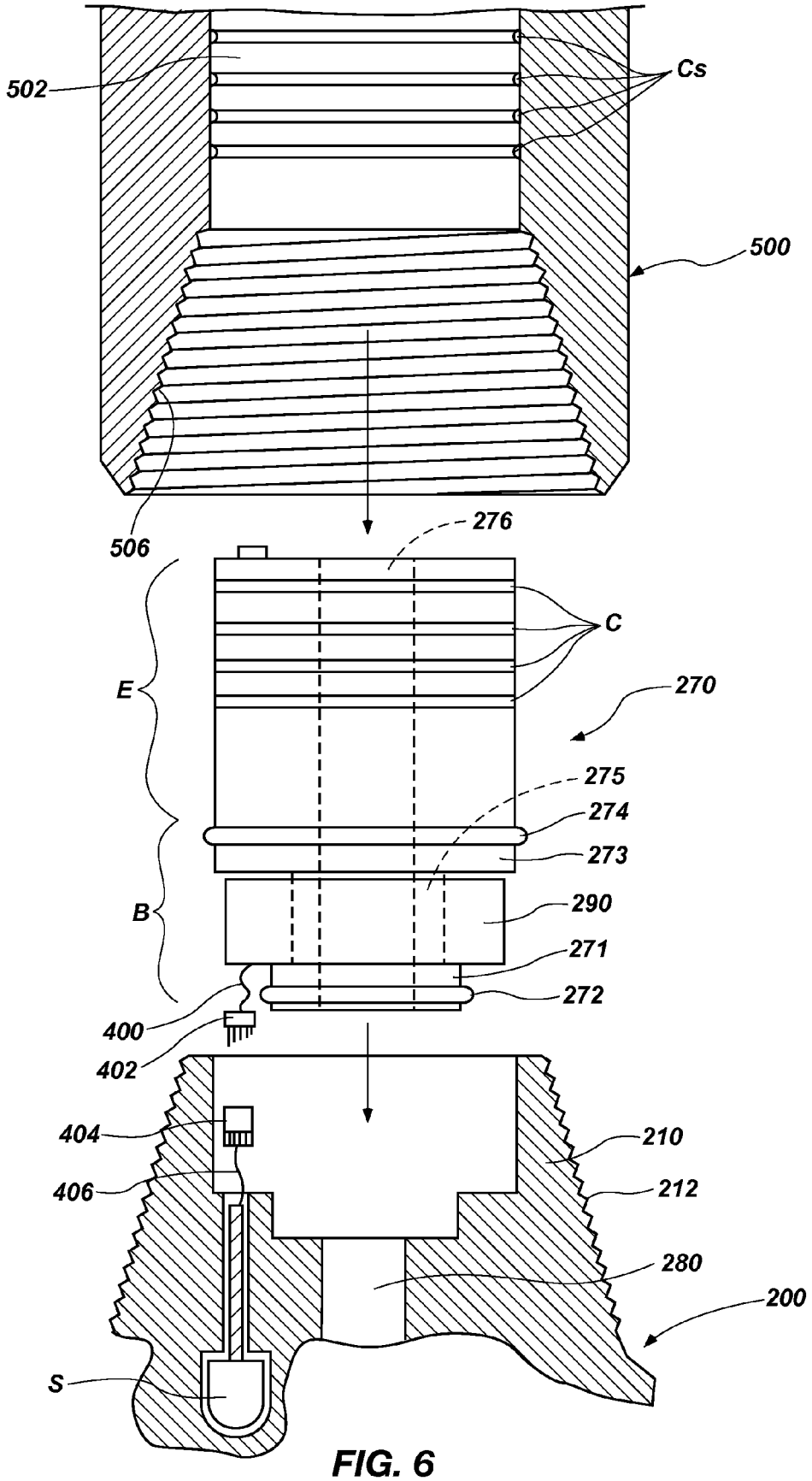
FIG. 6 is a schematic, exploded partial cross-sectional view of a data acquisition module according to an embodiment of the disclosure, the data acquisition module having a base disposed within a shank of a drill bit and an extension protruding from the shank into an interior of a sub secured to the bit shank and carrying components for further data transfer to a location remote from a bottom hole assembly including the drill bit and the sub.

FIG. 6 depicts data acquisition module 270 having a base B disposed in bore of shank 210 of a drill bit 200. First and second sealing rings 272 and 274 engage with the wall of bore to provide a sealed chamber for electronics module 290. As shown, electronics 290 may be physically connected via a communication element 400 in the form of, for example, an electrical conductor or a fiber optic cable to one or more sensors S disposed within the body of drill bit 200. A connector 402 connected to communication element 400 operably couples to a connector 404 communicating with electronics module 290 through another communication element 406. As can be seen in FIG. 6, the communication between the one or more sensors S and electronics module 290 is effected between first sealing ring 272 and second sealing ring 274 within the sealed chamber. Extension E of data acquisition module 270 is received within bore 502 of sub 500, which is secured to shank 210 of drill bit 200 by engagement of threads 212 on the exterior of shank 210 with threads 506 on the interior of distal end 508 of sub 500. When shank 210 is secured to distal end 508 of sub 500, contacts C, comprising annular rings, of data acquisition module, are longitudinally aligned with annular contacts CS of sub 500 and in lateral contact with contacts CS to provide a communication path between data acquisition module 270 and sub 500. Sub 500 may house, by way of non-limiting example, communications elements extending to a long-range communication system 146 above sub 500 in the bottom hole assembly or within sub 500 itself for transmitting data from electronics module 290 to the surface and, optionally, transmitting data from the surface to electronics module 290. Such data transmission may be effected, by way of example and not limitation, using an AXCELERATE™ Wired-Drillpipe Telemetry system or an AXCELERATE™ High-Speed Mud Pulse Telemetry system, each system available from operating units of Baker Hughes Incorporated, assignee of the present invention.

Although the foregoing description contains many specifics, these are not to be construed as limiting the scope of the present disclosure, but merely as providing certain embodiments. Similarly, other embodiments of the disclosure may be devised that do not depart from the scope of the present invention. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the invention, as disclosed herein, which fall within the meaning and scope of the claims, are encompassed by the present invention.

What is claimed is:

1. A data acquisition module comprising:

a base configured for disposition within a bore of drill bit shank, the base comprising a body, a flange of a diameter protruding radially from proximate a lower end of the body and bearing a peripheral sealing ring, another flange of a greater diameter protruding radially from proximate an upper end of the body and bearing another peripheral sealing ring;

an extension protruding upwardly from the other flange, of substantially the greater diameter of the other flange, bearing no peripheral sealing ring thereon and having electrical contacts on a peripheral exterior surface thereof;

a longitudinal bore extending through the base and the extension;

an electronics module carried by the base above the flange and operably coupled to the electrical contacts of the extension; and an elongated communication element extending from the electronics module radially outwardly of the peripheral sealing ring and to a location below the flange.

2. The data acquisition module of claim 1, wherein the electronics module is configured in substantially annular form and disposed within the base about the body and between the flange and the other flange and operably coupled to the electrical contacts.

3. The data acquisition module of claim 1, wherein the electrical contacts comprise longitudinally spaced, annular contacts on the peripheral exterior surface of the extension.

4. The bottom hole assembly of claim 1, wherein the electronics module is configured in substantially annular form and disposed within the base about the body and between the flange and the other flange and operably coupled to the electrical contacts.

5. A drill bit for drilling a subterranean formation comprising:

a bit body having a shank secured thereto, the shank having an outer bore of a first diameter, an inner bore of a second, smaller diameter and an annular step between the outer bore and the inner bore; and a base disposed within the bore of drill bit shank, the base comprising:

a body, a flange of a diameter protruding radially from proximate a lower end of the body and bearing a peripheral sealing ring contacting a wall of the inner bore, another flange of a greater diameter protruding radially from proximate an upper end of the body and bearing another peripheral sealing ring contacting a wall of the outer bore;

an extension protruding beyond the shank upwardly from the other flange, of substantially the greater diameter of the other flange, bearing no peripheral sealing ring thereon and having electrical contacts on a peripheral exterior surface thereof;

a longitudinal bore extending through the base and the extension;

an electronics module carried by the base above the flange and operably coupled to the electrical contacts of the extension; and a communication element extending from the electronics module radially outwardly of the peripheral sealing ring, through an aperture in the annular step to a location within the bit body below the flange.

6. The drill bit of claim 5, further comprising:

one or more sensors disposed within the bit body operably coupled to a another communication element terminating at a connector engaged with a connector of the communication element.

7. The drill bit of claim 5, wherein the electrical contacts comprise longitudinally spaced, annular contacts on the peripheral exterior surface of the extension.

8. The drill bit of claim 5, wherein the electronics module is configured in substantially annular form and disposed within the base about the body and between the flange and the other flange and operably coupled to the electrical contacts.

9. A bottom hole assembly including:

a drill bit comprising a bit body having a shank secured thereto, the shank having an outer bore of a first diameter, an inner bore of a second, smaller diameter and an annular step between the outer bore and the inner bore;

a base disposed within the bore of drill bit shank, the base comprising:

a body, a flange of a diameter protruding radially from proximate a lower end of the body and bearing a peripheral sealing ring contacting a wall of the inner bore, another flange of a greater diameter protruding radially from proximate an upper end of the body and bearing another peripheral sealing ring contacting a wall of the outer bore;

an extension protruding beyond the shank upwardly from the other flange, of substantially the greater diameter of the other flange, bearing no peripheral sealing ring thereon and having electrical contacts on a peripheral exterior surface thereof;

a longitudinal bore extending through the base and the extension;

an electronics module carried by the base above the flange and operably coupled to the electrical contacts of the extension;

a communication element extending from the electronics module radially outwardly of the peripheral sealing ring, through an aperture in the annular step to a location within the bit body below the flange; and a sub comprising a box connection secured to a pin connection of the shank and having electrical contacts on an interior surface thereof longitudinally upward of the box connection and operably coupled to the electrical contacts on the peripheral exterior surface of the extension.

10. The bottom hole assembly of claim 9, further comprising:

one or more sensors disposed within a body of the drill bit operably coupled to another communication element terminating at a connector engaged with a connector of the communication element.

11. The bottom hole assembly of claim 9, wherein the electrical contacts of the data acquisition module comprise longitudinally spaced, annular contacts on the peripheral exterior surface of the portion.

12. The bottom hole assembly of claim 9, wherein the electrical contacts of the sub comprise longitudinally spaced, annular contacts on the interior surface thereof.

* * * * *